US007197263B2

(12) United States Patent
Kadowaki et al.

(10) Patent No.: US 7,197,263 B2
(45) Date of Patent: Mar. 27, 2007

(54) DEVELOPER STORAGE DEVICE AND IMAGE FORMING APPARATUS

(75) Inventors: Hideaki Kadowaki, Kyoto (JP); Toshio Yamanaka, Yao (JP); Toshiya Mikita, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

(21) Appl. No.: 10/937,327

(22) Filed: Sep. 10, 2004

(65) Prior Publication Data

US 2005/0063730 A1 Mar. 24, 2005

(30) Foreign Application Priority Data

Sep. 18, 2003 (JP) ..... 2003-325854

(51) Int. Cl.
*G03G 15/08* (2006.01)

(52) U.S. Cl. ..... 399/120

(58) Field of Classification Search ..... 399/107, 399/110, 119, 120
See application file for complete search history.

(56) References Cited

U.S. PATENT DOCUMENTS 5,289,241 A * 2/1994 Sugiyama et al. ..... 399/120
5,589,915 A * 12/1996 Hashimoto ..... 399/120
5,708,952 A * 1/1998 Taniguchi et al. ..... 399/358
6,628,910 B2 * 9/2003 Tanisawa et al. ..... 399/120
6,882,812 B2 * 4/2005 Kasahara et al. ..... 399/120

FOREIGN PATENT DOCUMENTS

| | | |
|---|---|---|
| JP | 4-208958 | 7/1992 |
| JP | 6-258943 | 9/1994 |
| JP | 11-153901 | 6/1999 |

* cited by examiner

*Primary Examiner*—Hoan Tran
(74) *Attorney, Agent, or Firm*—Birch, Stewart, Kolasch & Birch LLP

(57) ABSTRACT

A developer storage device includes a storage container which supplies developer to a developing unit when rotated, and a collecting container for storing developer collected from an image forming section. The developer storage device further includes a first attaching and detaching portion allowing the storage container to be attached to and detached from a developer storage device body, and a second attaching and detaching portion allowing the collecting container to be attached to and detached from the developer storage device body.

7 Claims, 6 Drawing Sheets

DEVELOPER STORAGE DEVICE AND IMAGE FORMING APPARATUS

CROSS REFERENCE

This Nonprovisional application claims priority under 35 U.S.C. § 119(a) on Patent Application No. 2003-325854 filed in Japan on Sep. 18, 2003, the entire contents of which are hereby incorporated by reference.

BACKGROUND OF THE INVENTION

The present invention relates to a toner collecting container for cleaning and collecting toner that remains on an image carrier after transfer of a toner image formed on the image carrier to a recording medium, a toner supply cartridge for storing fresh toner and supplying the same to the developing section of an image forming apparatus, and an image forming apparatus using the toner collecting container and the toner supply cartridge.

In image forming apparatus of the type utilizing electrophotography, usually, toner used for development of an electrostatic latent image formed on an electrostatic latent image carrier is mostly transferred to a recording medium and hence consumed for image formation, but partly remains on the electrostatic latent image carrier.

A very small amount of toner that adheres to a surface of the image carrier other than the electrostatic latent image region and is not transferred to the recording medium, also remains on the electrostatic latent image carrier. Other toner fractions that also remain on the electrostatic latent image carrier without being transferred to the recording medium include a toner fraction that is deposited on the image carrier surface during various image forming process steps, for example, a toner fraction that is used to form a reference density pattern on the electrostatic latent image carrier for the purpose of process control (image quality control) for maintaining a good image quality.

In attempt to reuse such residual toner effectively, methods have hitherto been proposed of collecting such residual toner remaining on the electrostatic latent image carrier into a developing device by collecting and transporting residual toner to the developing device with a cleaning device or by making the developing device perform a cleaning operation instead of such a cleaning device.

Such recovered toner, however, has such inclusions as foreign matters (including powdery paper, particles resulting from wear of power transmission members, dust and trash) and aggregates of toner. Further, it is possible that recovered toner has an undesirably reduced particle size as compared with fresh toner.

Further, it is possible that recovered toner becomes difficult to charge due to deterioration caused by being subjected to repeated image forming process, that a drop occurs in the friction-based charge carrying ability of recovered toner because of stress given by transfer charge or the like, that recovered toner contains reversely charged toner, or that a drop occurs in the fluidity of recovered toner, which is one of the physical properties of recovered toner.

It is therefore very difficult to use a mixture of recovered toner and fresh toner. With such a mixture, it is difficult to maintain uniformity in toner density and stability in the amount of electric charge carried by toner. When a large amount of recovered toner is supplied to the developing device at a time, it is possible that not a few toner particles adhere to a blank portion other than the image carrying portion of a paper sheet to stain the blank portion, thus degrading the image quality, or that the toner in the developing device becomes easy to scatter. To avoid such inconveniences, one known image forming apparatus is designed to dispose of collected toner without reuse (see Japanese Patent Laid-Open Publications Nos. HEI 4-208958 and HEI 6-258943 for example.)

In disposing of collected toner without reuse, however, a container dedicated to collected toner is required so as not to mix collected toner in fresh toner. Each of the apparatus disclosed in the aforementioned Japanese Patent Laid-Open Publications Nos. HEI 4-208958 and HEI 6-258943 has an integral structure comprising a collecting section for storing collected toner and a fresh toner storage section for supplying fresh toner to the developing section. With such an integral structure, it is difficult to determine the capacity ratio between the fresh toner storage section and the collected toner storage section. This is because the ratio of the amount of collected toner to the amount of toner used is not constant but greatly varies depending on operating states of image forming apparatus including, for example, an operating state where the image forming apparatus is operated frequently and an operating state where the image forming apparatus is operated occasionally. Particularly where toner is deposited on a surface of the latent image carrier to form a reference density pattern for the purpose of process control (image quality control) for maintaining a good image quality, the toner used is wholly collected and, hence, the amount of collected toner becomes considerably large when the frequency of image quality control is high.

Usually, image quality control includes forming a density patch image on the image carrier and then detecting this image. Based on the image thus detected, processing means associated with respective image forming process steps are controlled to maintain image formation of good quality. The image quality control is conducted taking account of the number of images having been formed so far, environmental conditions around the image forming apparatus, and like factors. Accordingly, the frequency of image quality control in the case of frequent image formation is higher than that in the case of occasional image formation.

Since toner used in image quality control is wholly collected into the collecting section, the amount of collected toner grows larger as the frequency of image quality control increases. For this reason, the capacity of the collected toner storage section needs to be set large enough, which results in an undesirably increased space required for the collected toner storage section. If the capacity of the collected toner storage section is relatively small, fresh toner still remains in the fresh toner storage section formed integral with the collected toner storage section when the collected toner storage section becomes fully filled with collected toner. As a result, there arises a problem that the integral toner storage device needs to be wholly replaced with a new one before the fresh toner in the fresh toner storage section is wholly used.

A feature of the present invention is to provide a developer storage device including a fresh toner storage section and a collected toner storage, which are independent of and removable from each other.

SUMMARY OF THE INVENTION

According to the present invention, there is provided a developer storage device including: a storage container for storing developer to be supplied to a developing unit of an image forming apparatus, the storage container being configured to be rotated; a collecting container for storing developer collected from an image forming section of the image forming apparatus; a first attaching and detaching portion allowing the storage container to be attached to and detached from a developer storage device body; and a second attaching and detaching portion allowing the collecting container to be attached to and detached from the developer storage device body.

This construction not only allows replacement of the storage container and replacement of the collecting container to be achieved at a time but also enables the storage container and the collecting container to be combined so that the capacity ratio therebetween varies differently. Thus, developer storage devices having different combinations can be selectively and easily supplied in cases where there are used plural models of image forming apparatus having different image forming capabilities, and where a single image forming apparatus is used in different operating states, and in a like case.

In an embodiment of the present invention, the collecting container is provided with a developer collecting port for introducing the developer collected from the image forming section into the collecting container, and a first blade member rotatably supported for stirring the collected developer introduced through the developer collecting port and moving the same away from the developer collecting port.

This arrangement prevents the developer collected through the collecting port from heaping up to lower the storage capability while packing the collected developer in an end portion of the collecting container on the side away from the collecting port, namely, in a deep portion of the collecting container.

In another embodiment of the present invention, the collecting container is provided with a second blade member rotatably supported for stirring the developer having been moved away from the collecting port by the first blade member.

Still another embodiment of the present invention further includes a second joint removably fitted to one end of the storage container at an external surface of wall forming the collecting container for transmitting rotation of the storage container to the second blade member.

Still another embodiment of the present invention further includes a first joint removably fitted to the developing unit at an external surface of the collecting container for transmitting rotation of a stirring roller located in the developing unit, and a second joint removably fitted to one end of the storage container at an external surface of the collecting container for transmitting rotation of the storage container to the second blade member, wherein: the first joint is located adjacent the developer collecting port, while the second joint is located farther than the first joint from the developer collecting port; and the first blade member connected to the first joint is configured to rotate with rotation of the stirring roller located in the developing unit, while the second blade member connected to the second joint is configured to rotate with rotation of the storage container.

In this arrangement, the first blade member connected to the stirring roller located in the developing unit rotates at a location adjacent the collecting port, thereby preventing developer from forming a heap of developer at that location. At a location apart from the collecting port, the second blade member rotates with rotation of the storage container only when fresh developer is supplied to the storage container, whereby the second blade member does not rotate for a longer period than necessary.

The foregoing and other features and attendant advantages of the present invention will become more apparent from the reading of the following detailed description of the invention in conjunction with the accompanying drawings.

DETAILED DESCRIPTION OF THE PREFERRED EMBODIMENTS

Figure 1:
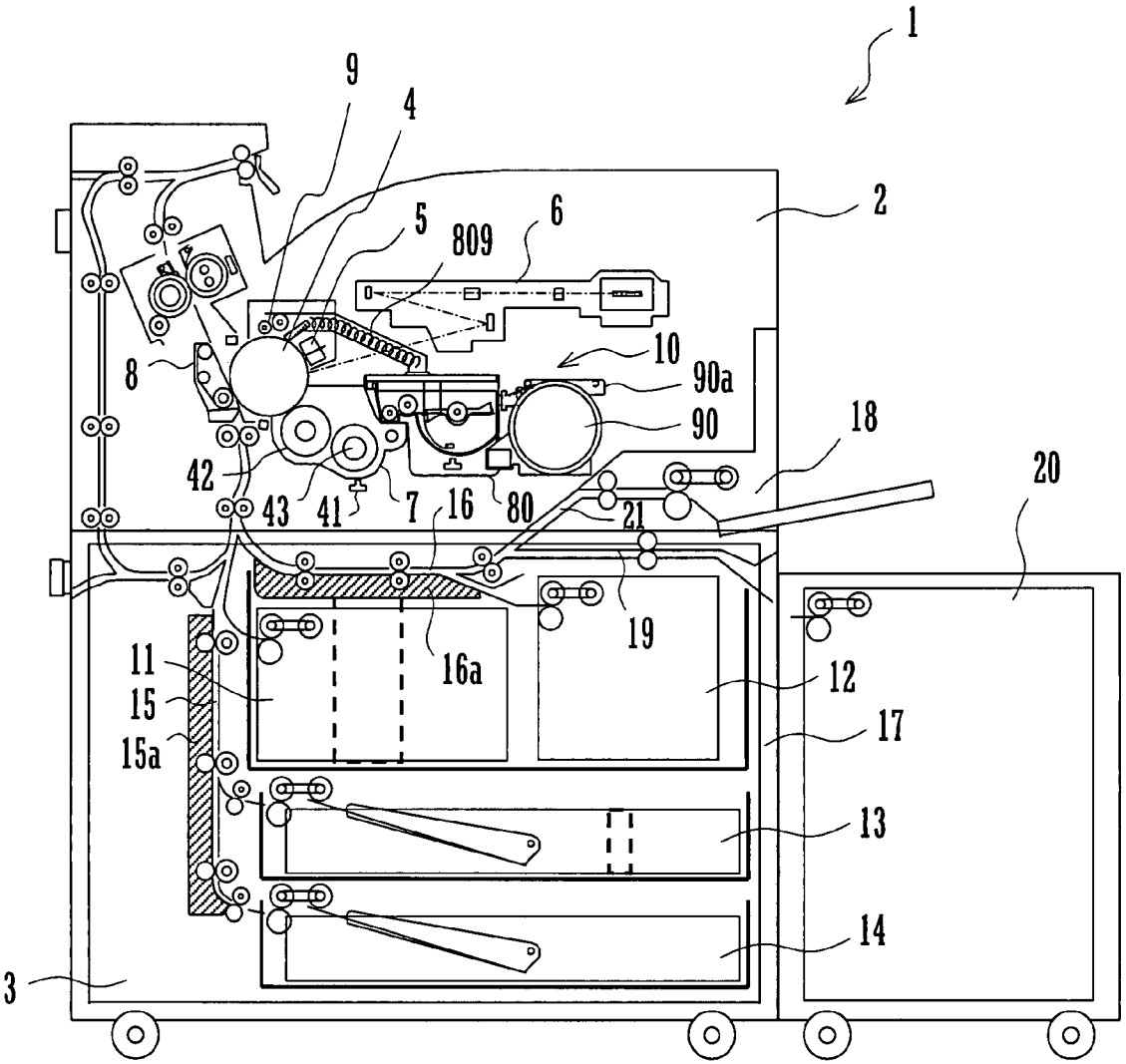
FIG. 1 is a view showing the construction of an image forming apparatus incorporating developer storage means according to an embodiment of the present invention.

Hereinafter, an image forming apparatus incorporating developer storage means embodying the present invention will be described in detail with reference to the accompanying drawings.

The image forming apparatus 1 according to this embodiment includes a printer section (image forming section) 2, and a paper feed unit section 3 disposed below the printer section 2. An electrophotographic processing section is located generally centrally of the printer section 2 and includes a photosensitive drum 4 formed with a photosensitive layer, the photosensitive drum 4 being centered in the electrophotographic processing section.

Specifically, around the photosensitive drum 4 there are disposed electrostatic charger unit 5, optical scanning unit 6, developing unit 7, transfer unit 8 and cleaning unit 9.

The electrostatic charger unit 5 electrostatically charges the surface of photosensitive drum 4 uniformly. The optical scanning unit 6 irradiates the uniformly charged photosensitive drum 4 with an optical image thereby to form an electrostatic latent image thereon. The developing unit 7 visualizes the electrostatic latent image formed by the optical scanning unit 6 using developer. The transfer unit 8 transfers the image visualized on the photosensitive drum 4 to a recording medium, while the cleaning unit 9 eliminates residual developer (toner) remaining on the photosensitive drum 4 thereby making the photosensitive drum 4 ready to record another image.

The residual toner eliminated by the cleaning unit 9 is collected into a will-be-described collecting container included in a toner supply cartridge 10 of the developing unit 7 by means of a toner collecting mechanism 809. Thereafter, the residual toner is subjected to disposal.

The paper feed unit section 3 includes plural paper feed trays (recording medium feed sections) 11 to 14. The paper feed unit section 3 is capable of holding various types of recording sheets separately on a size basis for example.

The image forming apparatus 1 selects one of the paper feed trays 11 to 14 and feeds recording sheets one by one from the selected paper feed tray to between the photosensitive drum 4 and the transfer unit 8. In turn, the transfer unit 8 transfers the image recorded and reproduced on the photosensitive drum 4 to a recording sheet thus fed.

The paper feed tray (first recording medium feed section) 11 and the paper feed tray (second recording medium feed section) 12 are disposed side by side. The paper feed tray 13 is disposed below these trays 11 and 12 while the paper feed tray 14 disposed below the tray 13.

The paper feed trays 13 and 14 have substantially equal capacity, whereas the paper feed trays 11 and 12 each have a larger capacity than the paper feed tray 13 or 14.

The paper feed unit section 3 has first feed path 15 and second feed path 16 for feeding the recording sheets held in each of the paper feed trays 11 to 14 toward the printer section 2. The first feed path 15 is adapted to feed the recording sheets held in each of the paper feed trays 11, 13 and 14 toward the printer section 2, while the second feed path 16 adapted to feed the recording sheets held in the paper feed tray 12.

The first feed path 15 extends vertically along a frame 17 of the paper feed unit section 3. On the other hand, the second feed path 16 extends horizontally along the frame 17.

Thus, the paper feed trays 11 to 14 and the first and second feed paths 15 and 16 are disposed within the paper feed unit section 3 efficiently, thereby realizing space-saving for the paper feed unit section 3.

In setting recording sheets in each of the paper feed trays 11 to 14, an intended one of the paper feed trays 11 to 14 is drawn out in the direction in which the front face of the image forming apparatus 1 body is oriented, so as to be replenished with recording sheets.

When a jam occurs in the first feed path 15, the user standing in front of the image forming apparatus 1 turns guide 15*a* (hatched in the figure) forming part of the first feed path 15 about a point located on the deep side of the paper feed unit section 3 toward him or her. By so doing, the user can remove the jamming recording sheet(s) from the first feed path 15. This removing operation is performed utilizing a work space previously secured between the first feed path 15 and the frame 17.

Similarly, when a jam occurs in the second feed path 16, the user standing in front of the image forming apparatus 1 turns guide 16*a* (hatched in the figure) forming part of the second feed path 16 about a point located deep in the paper feed unit section 3 toward him or her. By so doing, the user can remove the jamming recording sheet(s) from the second feed path 16. This removing operation is performed after a work space has been secured under the second feed path 16 by drawing out the juxtaposed paper feed trays 11 and 12 toward the user.

Though the image forming apparatus 1 according to this embodiment is configured to allow the paper feed trays 11 and 12 to be drawn out at a time, the present invention is not necessarily limited to this configuration. It is possible to employ a configuration such as to allow these trays to be drawn out independently of each other. In this case, a work space for removal of jamming recording sheet(s) from the second feed path 16 can simply be secured under the second feed path 16 if the paper feed tray 11 is drawn out toward the user.

On the side downstream of the second feed path 16 is provided a manual paper feed unit 18 for setting a relatively small amount of recording sheets therein.

It is highly possible that special recording sheets, if anything, are set in the manual paper feed unit 18. This is because the manual paper feed unit 18 allows recording sheets to be set therein or replaced with other type of recording sheets conveniently. The recording sheets in the manual paper feed unit 18 can be fed to the second feed path 16 via a third feed path 21.

A paper feed unit 20 as an optional device may be coupled to the paper feed unit section 3 on the right-hand side in the figure. The paper feed unit 20 has a larger capacity than any one of the paper feed trays 11 to 14. Recording sheets fed from the paper feed unit 20 are guided to the printer section 2 through a fourth feed path 19 and then the second feed path 16.

The developing section includes: the developing unit 7 having a developing roller and a stirring device; an intermediate hopper 80 removably set on the developing unit 7 substantially horizontally for supplying suitable toner into the developing unit 7; and the toner supply cartridge 10 removably fitted to the intermediate hopper 80. In the developing section thus arranged, the toner supply cartridge 10 fails to interfere with exposure of the photosensitive drum 4, while the mechanism of this section is rendered compact.

The developing unit 7 includes a toner density sensor 41 for keeping toner to be fed to the photosensitive drum 4 at a predetermined density, developing roller 42, stirring roller 43, and the like.

The developing roller 42 comprises a hollow cylindrical developing sleeve formed from a non-magnetic metal such as an aluminum alloy, brass or SUS304 stainless steel, and a magnet roller inserted into the developing sleeve, the magnet roller having plural magnetic members fixed thereon for producing a magnetic field. The developing roller 42 magnetically attracts developer on the surface thereof to feed the developer to the developing section adjoining the photosensitive drum 4 while rotating only the developing sleeve.

The stirring roller 43 and the developing roller 42 are driven for rotation by a non-illustrated driver in response to instructions from a non-illustrated control section.

The toner density sensor 41 is disposed below the developing unit 7 for detecting the toner density of the developer in the developing unit 7 as a voltage (density detection voltage). The voltage thus detected is compared to a reference voltage. When the toner density in the developing unit 7 is lower than necessary, a drive signal is outputted to a non-illustrated driving section associated with a toner supply roller 802 located in the intermediate hopper 80.

In this embodiment, the developer used is of a two-component system and is stirred so that toner is electrostatically charged due to friction. The charged toner is allowed to be electrostatically attracted onto an electrostatic latent image formed on the photosensitive drum 4, thus forming a visible image. The developing unit 7 of this type uses a permeability sensor as the toner density sensor for toner density measurement, but use of a toner density sensor of the differential transformer type may be made.

The toner supply cartridge 10, which is the "developer storage device" defined by the present invention, includes a toner collecting container 70, a toner supply member 90, and a cartridge receiver member 80*a* for removably attaching the toner supply member 90 to the intermediate hopper 80.

The toner supply member 90, which is shaped cylindrical, is connected to a non-illustrated driving section so that its outer part rotates to supply toner to the intermediate hopper 80 with stirring. The toner supply member 90 is removably attached to the intermediate hopper 80 by means of the cartridge receiver member 80*a*.

The toner collecting container 70 is also structured to be attachable to and detachable from each of the intermediate hopper 80 and the toner supply member 90 by means of a coupling and a fastening screw to be described later.

Figure 2:
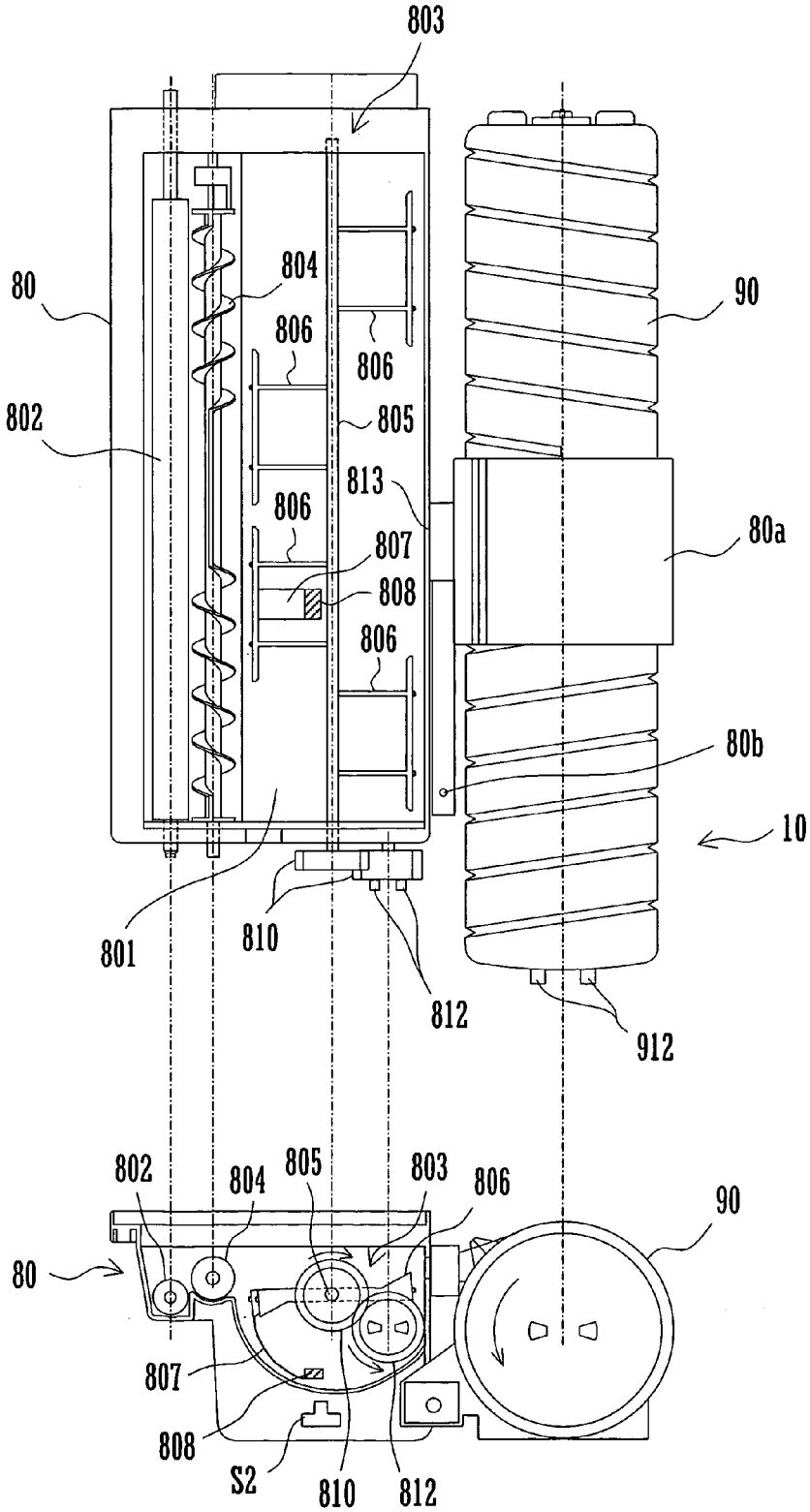
FIG. 2 is an illustration including a plan view and sectional side elevation of a developer storage container used in the image forming apparatus.
Figure 3:
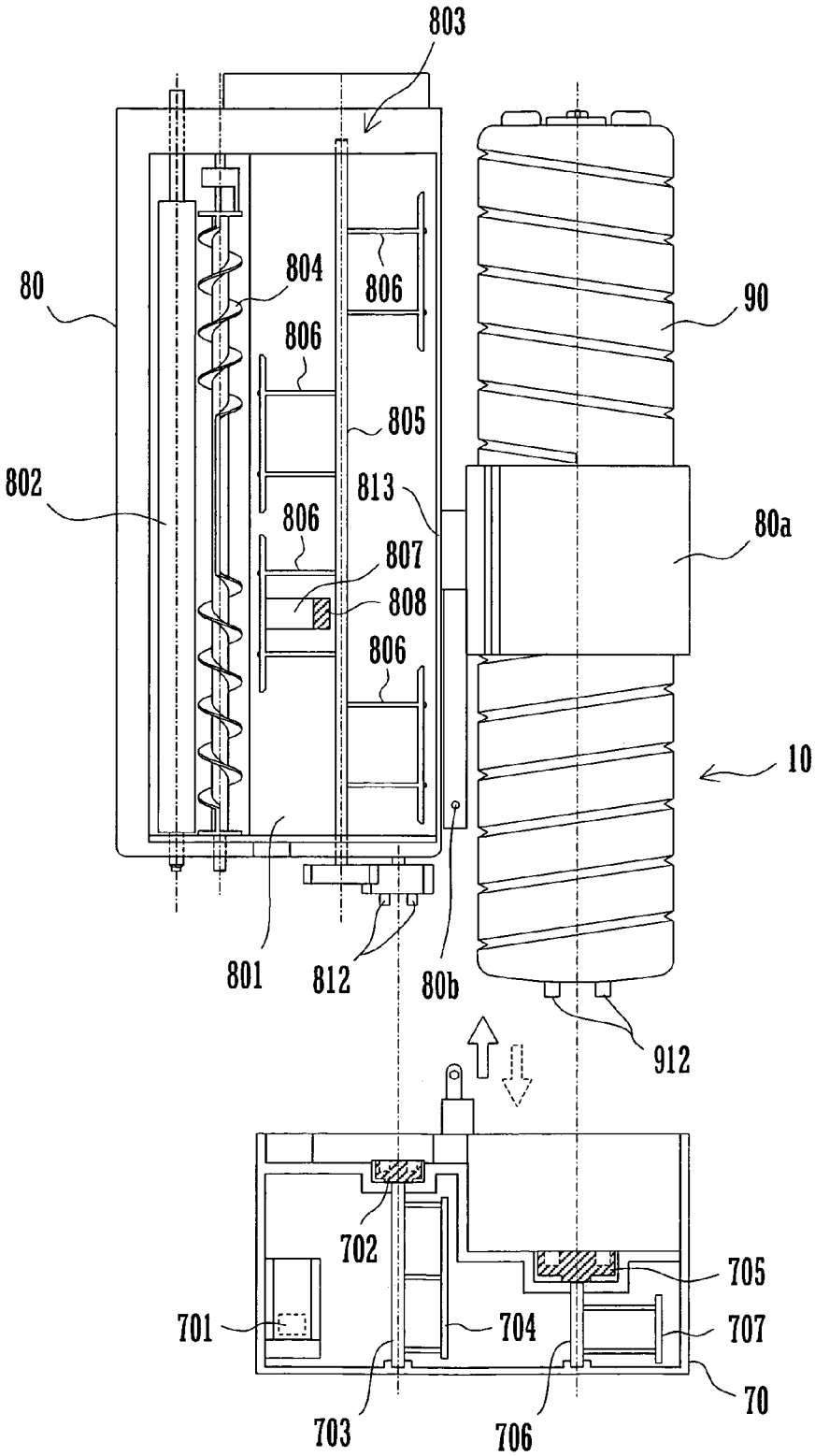
FIG. 3 is a plan view showing the developer storage container in a state where a storage container is separated from a collecting container.
Figure 4:
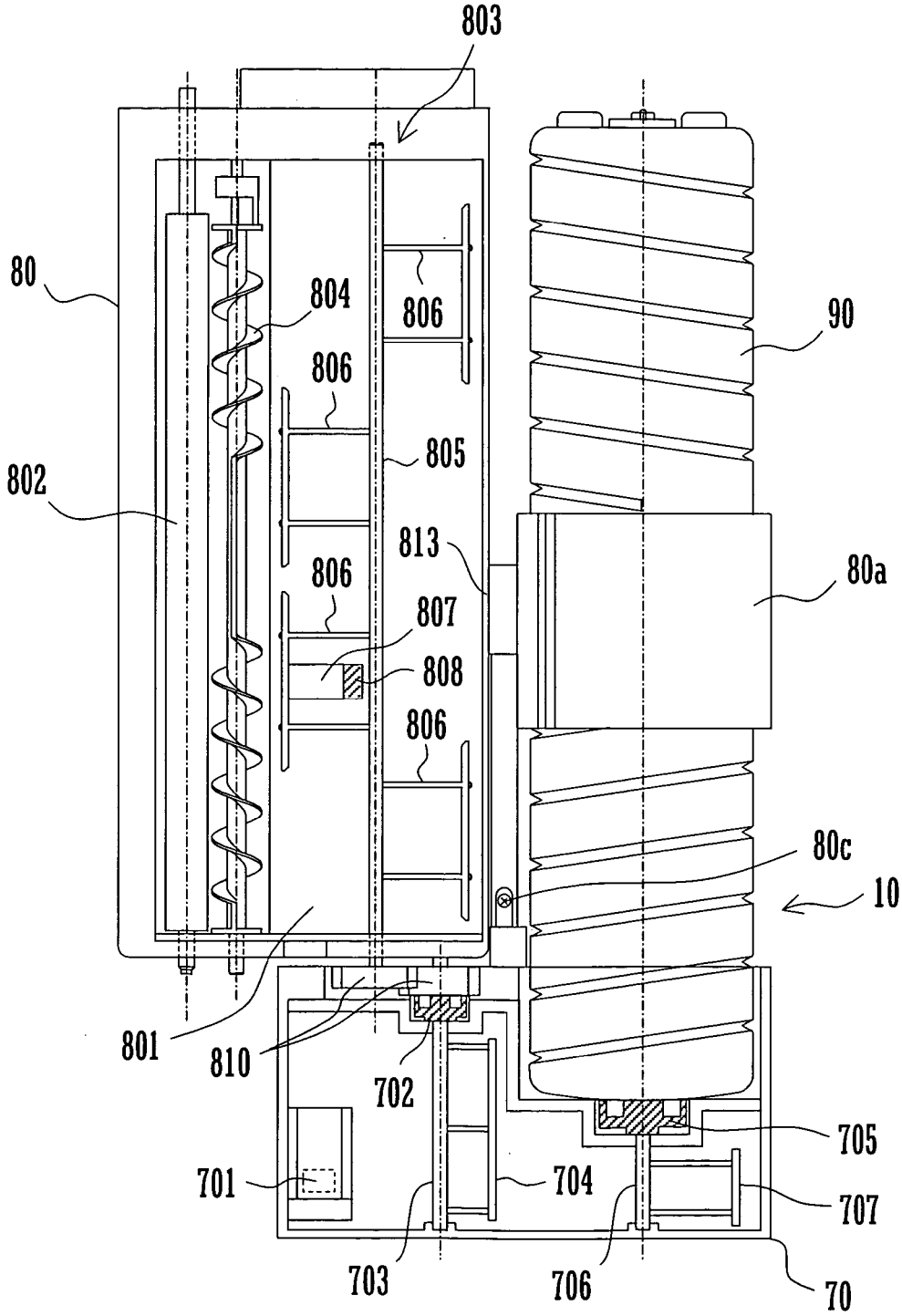
FIG. 4 is a plan view of the developer storage container.

In the embodiment shown, the cylindrical body of the toner supply member 90 has a helical portion therein for gathering toner present in opposite end portions of the cylindrical body toward a central portion. Thus, there is no need to provide any stirrer to be rotary-driven within the toner supply member 90 or any feeder for feeding toner from the toner supply member 90 to the intermediate hopper 80. The toner supply member 90 defines a toner supply port 91 generally centrally thereof (see FIG. 5). The toner supply port 91 is connected to a toner receiving port 813 defined generally centrally of the intermediate hopper 80 (see FIGS. 2 to 4) so that toner can be supplied from the toner supply member 90 to the intermediate hopper 80 through this connection.

Such an arrangement can lower the parts count of the toner supply member 90 as a replacement member, thereby further reducing the cost of the toner supply cartridge 10. When a sensor S2 (see FIG. 2) detects the fact that the amount of toner within the intermediate hopper 80 is smaller than a predetermined amount, the non-illustrated driving section causes the toner supply member 90 to rotate for a predetermined time period thereby to supply toner from the toner supply member 90 to the intermediate hopper 80.

If the amount of toner within the intermediate hopper 80 does not recover to the predetermined amount in spite of supply of toner for the predetermined time period, the toner supply member 90 is judged to have run out of toner and a non-illustrated display device or a like device notifies the user of this status. The user thus notified simply has to draw out the toner supply cartridge 10, detach the toner collecting container 70, detach the toner supply member 90 from the intermediate hopper 80 and then replace only the toner supply member 90 with a new one.

In the case where the toner collecting container 70 is substantially full of collected toner at the time toner stored in the toner supply member 90 thoroughly runs out, the toner supply cartridge 10 is to be wholly replaced with a new one. If the volume of the toner collecting container 70 is considerably smaller than the volume of the toner supply member 90, the toner collecting container 70 becomes full of collected toner before the toner supply member 90 becomes empty. In this case only the toner collecting container 70 is replaced with a new one.

Figure 5:
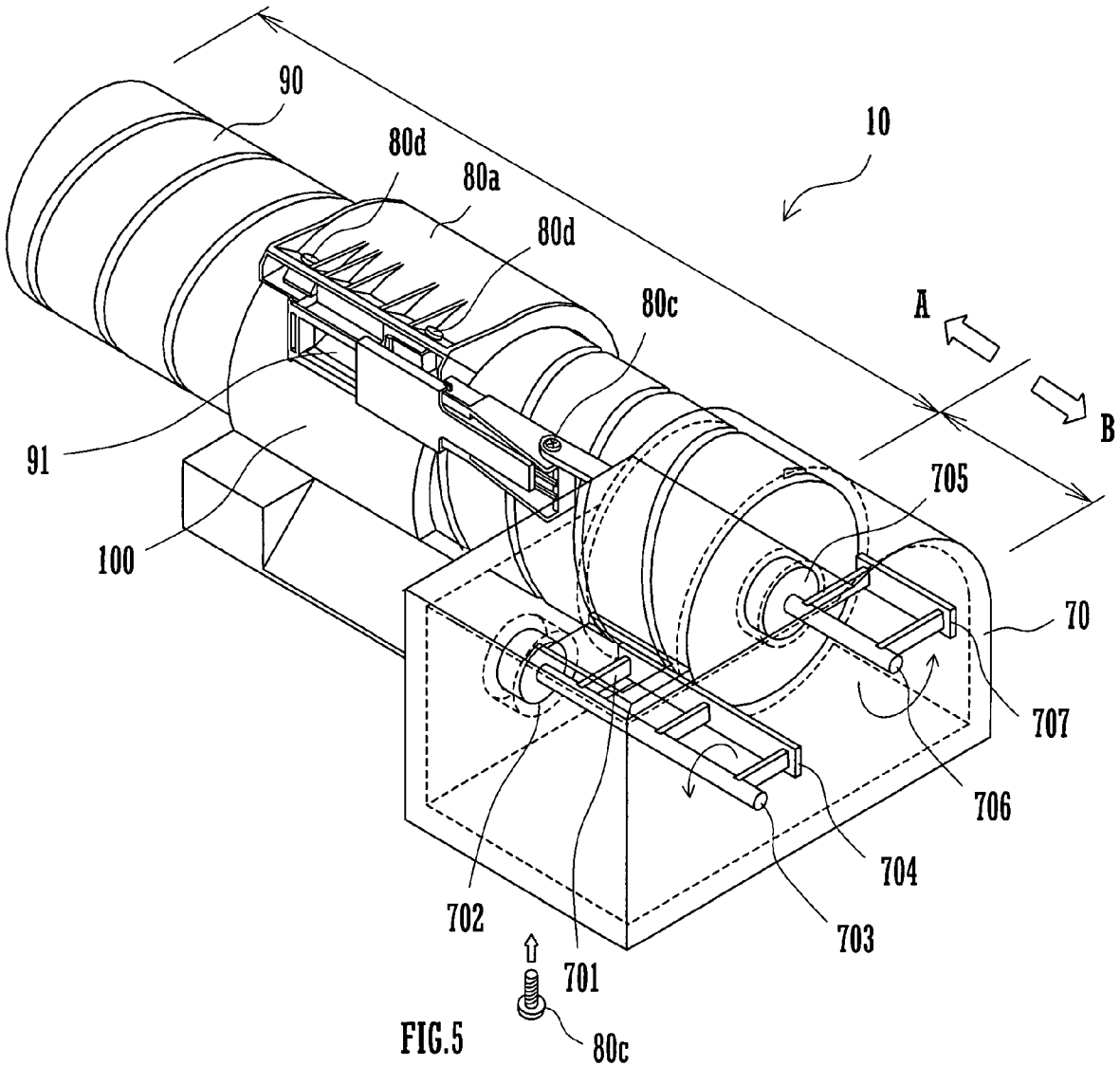
FIG. 5 is a perspective view of the developer storage container.

For replacement of the toner collecting container 70, a support 100 (see FIG. 5) has a threaded hole 80*b* (see FIGS. 2 and 3) at a shutter guide portion for thread engagement with a fastening screw 80*c*. The engagement between the threaded hole 80*b* and the fastening screw 80*c* enables the toner collecting container 70 to be fixedly fitted to the support 100. As shown in FIG. 5, the number of such fastening screws is, for example, two for fixing the toner collecting container 70 at two points from above and from below with the same fastening structure. The lower fastening screw is not shown here.

The cartridge receiver member 80*a*, which is provided for replacement of the toner supply member 90, can be fixed to the support 100 with two fastening screws 80*d*. The cartridge receiver member 80*a* and the support 100 fix the toner supply member 90 by sandwiching it from above and from below. Detachment of the cartridge receiver member 80*a* allows the toner supply member 90 to be removed. The manner of fixing with screw is not limited to that described above.

In the case where the toner supply member 90 becomes empty before the toner collecting container 70 becomes full of collected toner, only the toner supply member 90 needs to be replaced.

Before the replacement of the toner supply member 90, the two fastening screws 80*d* are removed after detachment of the toner collecting container 70.

It is recommended that plural toner supply members 90 having different lengths (different capacities) and plural toner collecting containers 70 having different capacities be provided. Such toner supply members and such toner collecting containers may be combined to accommodate different operating states of respective image forming apparatus. In this case, combinations can be selected appropriately for image forming apparatus having different image forming capabilities, or a suitable combination can be selected from plural combinations depending on a operating state of a single image forming apparatus.

If the toner supply member 90 and the toner collecting container 70 are varied in their respective shapes so that the boundary between the toner supply member 90 and the toner collecting container 70 shifts in the direction of arrow A or B in FIG. 5, the capacity ratio between the toner supply member 90 and the toner collecting container 70 can be varied without changing the outside dimensions of the toner supply cartridge 10.

The toner collecting port of the toner collecting container 70 is usually closed with a shutter biased by a spring or the like. The shutter is retracted to define a toner collecting path by insertion of the toner supply cartridge 10.

In fitting the toner supply cartridge 10 to the intermediate hopper 80, a non-illustrated lock member provided on the intermediate hopper 80 is caused to engage the support 100 of the toner supply cartridge 10, thereby fixing the toner supply cartridge 10 to the intermediate hopper 80. In this arrangement a sensation of a click is obtained at the time the toner supply cartridge 10 becomes fitted to the intermediate hopper 80.

The toner supply cartridge 10 as assembled may be wholly replaced with a new one, or only the toner collecting container 70 as detached may be subjected to replacement. Alternatively, replacement of only the toner supply member 90 is possible. Such replacement can be achieved in a manner desired by the user or a serviceman.

The toner collecting container 70 comprises toner collecting port 701, first coupling 702, first rotating shaft 703, first blade member 704, second coupling 705, second rotating shaft 706, and second blade member 707. The toner collecting port 701 is located close to toner collecting mechanism 809 (see FIG. 1) for collecting toner remaining on the photosensitive drum 21 and is connectable to the outlet of the toner collecting mechanism 809.

The first coupling 702, which is located adjacent an end portion at which the toner collecting port 701 is located (adjacent the left-hand end portion in FIG. 4), is provided as a joint (first joint in this embodiment) configured to be fitted over projections 812 extending from a gear 810 which rotates together with a stirring member outside the intermediate hopper 80. Thus, the gear 810 and the first coupling 702 transmit the rotary power of the stirring member of the intermediate hopper 80 to the blade member 704 of the toner collecting container 70 for rotation. The first coupling 702 is joined with the first rotating shaft 703 attached with the first blade member 704, which is shaped like a ladder and rotates together with the rotating shaft 703 to stir toner. On the other hand, the second coupling 705, which is located adjacent an end portion on the side away from the toner collecting port 701 (adjacent the right-hand end portion in FIG. 4), is provided as a joint (second joint in this embodiment) configured to be fitted over projections 912 (see FIG. 3) extending from an end portion of the toner supply member 90. The second coupling 705 is joined with the second rotating shaft 706. The second rotating shaft 706, in turn, is attached with the second blade member 707 which is shaped like a ladder and rotates together with the rotating shaft 706 to stir toner.

Toner fed from the toner collecting mechanism 809 enters the toner collecting container 70 through the toner collecting port 701. If collected toner is accumulated as heaped up in the toner collecting container 70 at a location adjacent the toner collecting port 701, the toner collecting container becomes incapable of further collecting toner through the toner collecting port 701. For this reason, the first blade member 704 is rotatably supported at a location adjacent the toner collecting port 701 for moving collected toner toward the deep side in the toner collecting container 70 while collapsing a heap of collected toner. The toner collecting container 70 is further provided with the second blade member 707 for advancing collected toner toward the deeper side in the toner collecting container 70 so as to store collected toner as much as possible.

The second blade member 707 is of the same structure as the first blade member 704, but utilizes the rotary power of the toner supply member 90. Specifically, the second blade member 707 located on the deeper side in the toner collecting container 70 is so structured as to rotate as the toner supply member 90 rotates for supply of toner. Accordingly, the toner collecting operation can commensurate with the supply of toner.

The intermediate hopper 80 includes toner storage section 801, toner supply roller 802, stirring member 803, and toner feed screw 804. The stirring member 803 and the toner feed screw 804 are capable of feeding toner supplied from the toner supply member 90 toward the toner supply roller 802 with stirring.

Figure 6:
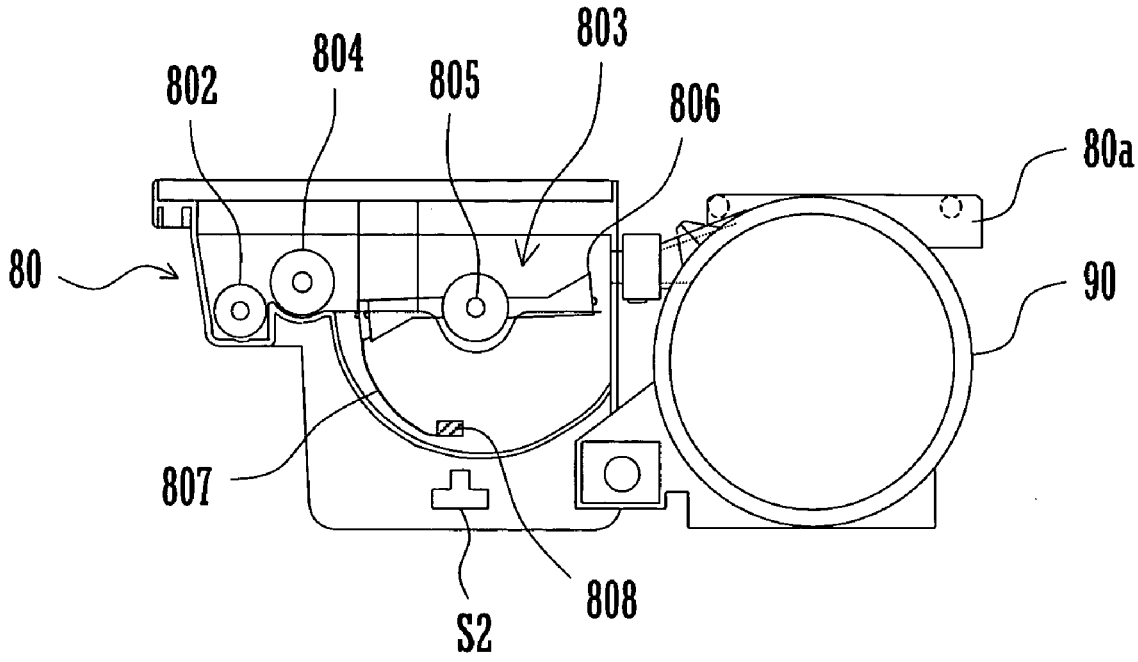
FIG. 6 is a sectional side elevation of the developer storage container.

Stirring blade 806 in the form of a comb or ladder rotates clockwise about support shaft 805 of the stirring member 803, while the toner supply roller 802 rotates to supply toner to the developing unit 7. Reference character S2 (see FIG. 6) denotes a detector section for determining the amount of toner remaining in the toner cartridge. The detector section employs a sensor equivalent to the permeability sensor employed in the aforementioned section for measuring the density of toner as the developer.

The stirring blade 806 is attached with a sheet 807 formed from a flexible polymer. The sheet 807 is provided with a detection target member 808 at its tip. When the amount of toner present in the intermediate hopper 80 is relatively large, the detection target member 808 revolves along a substantially cylindrical narrow hollow formed by rotation of the stirring blade 806. On the other hand, when the amount of toner is decreased, the detection target member 808 draws a locus passing near the sensor S2 because of its gravity. Accordingly, the output of the sensor S2 is variable. The amount of toner remaining in the cartridge can be found by checking the value of an output.

Preferably, the sheet 807 is set to have a length long enough to allow the detection target member 808 to become sliding contact with a bottom portion of the enclosure of the intermediate hopper 80. If the sheet 807 is shorter than that length, detection of the amount of remaining toner becomes difficult. The length of the sheet 807 is preferably shorter than the distance from the center of the support shaft 805 of the stirring member 803 to an inner wall surface directly below the support shaft 805. If the length of the sheet 807 is too long, the sheet 807 and the stirring member 803 interfere with each other, which makes it difficult to ensure smooth operation.

The sheet 807 desirably has such flexibility as to allow the detection target member 808 to swing by gravity. If the flexibility of the sheet 807 is relatively low, the relatively high rigidity of the sheet 807 might bring about such an inconvenience as to cause the detection target member 808 to sink into the toner layer or swing in the air at a position apart from the toner layer because the resistance of toner is very low when toner becomes fluidized by the stirring member 803. The material of the sheet 807 is desirably a polymeric material such as PET. If the sheet 807 is formed from a metal, it is difficult for the sensor S2 to distinguish the detection target member 808 from the sheet 807 and, hence, detection errors are likely.

It is possible to employ any method which can detect the amount of remaining toner based on the distance between the detection target member and the sensor which varies as the amount of remaining toner varies. For example, it is possible to employ a method such as to detect the vertical position of a float placed on the upper surface of the toner layer or a method such as to use a piezoelectric sensor or a like sensor to detect the amount of remaining toner.

While only certain presently preferred embodiments of the present invention have been described in detail, as will be apparent for those skilled in the art, certain changes and modifications may be made in embodiments without departing from the spirit and scope of the present invention as defined by the following claims.

What is claimed is:

1. A developer storage device comprising:

a cylindrical storage container for storing developer to be supplied to a developing unit of an image forming apparatus, the cylindrical storage container being rotatably supported so as to allow the developer to be supplied to the developing unit while being stirred;

a collecting container for storing developer collected from an image forming section of the image forming apparatus;

a first attaching and detaching portion allowing the cylindrical storage container to be attached to and detached from a developer storage device body; and a second attaching and detaching portion allowing the collecting container to be attached to and detached from the developer storage device body.

2. The developer storage device according to claim 1, wherein the collecting container is provided with a developer collecting port for introducing the developer collected from the image forming section into the collecting container, and a first blade member rotatably supported for stirring the collected developer introduced through the developer collecting port and moving the same away from the developer collecting port.

3. The developer storage device according to claim 2, wherein the collecting container is provided with a second blade member rotatably supported for stirring the developer having been moved away from the collecting port by the first blade member.

4. The developer storage device according to claim 3, further comprising a first joint removably fitted to developer storage device body at an external surface of the collecting container for transmitting rotation of a stirring roller located in the developer storage device body.

5. The developer storage device according to claim 4, further comprising a second joint removably fitted to one end of the cylindrical storage container at an external surface of the collecting container for transmitting rotation of the cylindrical storage container to the second blade member.

6. The developer storage device according to claim 5, wherein:

the first joint is located adjacent the developer collecting port, while the second joint is located farther than the first joint from the developer collecting port; and the first blade member connected to the first joint is configured to rotate with rotation of the stirring roller located in the developer storage device body, while the second blade member connected to the second joint is configured to rotate with rotation of the cylindrical storage container.

7. An image forming apparatus comprising:

a photosensitive drum having a photosensitive layer;

an optical scanning unit operative to form an electrostatic latent image by irradiating a surface of the photosensitive drum with an optical image;

a developing unit operative to form a visible image by applying developer to the electrostatic latent image formed by the optical scanning unit;

a transfer unit operative to transfer the visible image formed on the photosensitive drum to a recording sheet; and a developer storage device fitted to the developing unit for supplying developer to the developing unit, the developer storage device comprising:

a cylindrical storage container for storing developer to be supplied to a developing unit of an image forming apparatus, the cylindrical storage container being rotatably supported so as to allow the developer to be supplied to the developing unit while being stirred;

a collecting container for storing developer collected from the photosensitive drum;

a first attaching and detaching portion allowing the cylindrical storage container to be attached to and detached from a developer storage device body; and a second attaching and detaching portion allowing the collecting container to be attached to and detached from the developer storage device body.

* * * * *